US007906187B2

(12) United States Patent
Bi et al.

(10) Patent No.: US 7,906,187 B2
(45) Date of Patent: Mar. 15, 2011

(54) INK JET RECORDING SHEET WITH PHOTOPARITY

(75) Inventors: Yubai Bi, San Diego, CA (US); Pierre-Alain Brugger, Ependes (CH); Martin Staiger, Clarens (CH); Rolf Steiger, Praroman-Le Mouret (CH); Karl Peternell, Fribourg (CH)

(73) Assignee: Hewlett-Packard Development Company, L.P., Houston, TX (US)

( * ) Notice: Subject to any disclaimer, the term of this patent is extended or adjusted under 35 U.S.C. 154(b) by 280 days.

(21) Appl. No.: 10/406,967

(22) Filed: Apr. 3, 2003

(65) Prior Publication Data

US 2004/0197498 A1 Oct. 7, 2004

(51) Int. Cl.
*B41M 5/40* (2006.01)

(52) U.S. Cl. ..... 428/32.25; 428/32.28; 428/32.29; 428/32.32; 428/32.35; 428/32.36

(58) Field of Classification Search ..... 428/32.25, 428/32.28, 32.29, 32.32, 32.35, 32.36
See application file for complete search history.

(56) References Cited

U.S. PATENT DOCUMENTS

| | | | | |
|---|---|---|---|---|
| 3,007,878 | A | 11/1961 | Alexander et al. | |
| 4,554,181 | A * | 11/1985 | Cousin et al. | 428/32.3 |
| 4,946,557 | A * | 8/1990 | Svending | 162/168.3 |
| 5,372,884 | A | 12/1994 | Abe et al. | |
| 5,463,178 | A | 10/1995 | Suzuki et al. | |
| 5,750,200 | A * | 5/1998 | Ogawa et al. | 427/361 |
| 5,958,168 | A * | 9/1999 | Liu et al. | 156/230 |
| 6,096,469 | A * | 8/2000 | Anderson et al. | 427/256 |
| 6,203,899 | B1 | 3/2001 | Hirose et al. | |
| 6,245,422 | B1 * | 6/2001 | Onishi et al. | 428/32.25 |
| 6,403,162 | B1 | 6/2002 | Tokunaga et al. | |
| 6,420,039 | B1 * | 7/2002 | Field et al. | 428/451 |
| 6,475,612 | B1 | 11/2002 | Knight et al. | |
| 6,492,005 | B1 * | 12/2002 | Ohbayashi et al. | 428/32.29 |
| 6,887,536 | B2 * | 5/2005 | De Voeght et al. | 428/32.36 |
| 2001/0004487 | A1 | 6/2001 | Kaneko et al. | |
| 2002/0034613 | A1 | 3/2002 | Liu et al. | |
| 2003/0039808 | A1 * | 2/2003 | Ichinose et al. | 428/195 |
| 2003/0219551 | A1 * | 11/2003 | Burch et al. | 428/32.1 |
| 2003/0224127 | A1 * | 12/2003 | Burch et al. | 428/32.1 |
| 2004/0033377 | A1 * | 2/2004 | Koenig | 428/458 |
| 2004/0189778 | A1 * | 9/2004 | Stork et al. | 347/105 |

FOREIGN PATENT DOCUMENTS

| | | | |
|---|---|---|---|
| EP | 1 016 546 | A2 | 9/1950 |
| EP | 1 162 076 | | 9/2002 |
| EP | 1 243 436 | A1 | 9/2002 |
| EP | 1 321 300 | A1 | 6/2003 |
| EP | 1 364 800 | A1 | 11/2003 |
| EP | 1452328 | A1 | 9/2004 |
| JP | 2001353957 | A | 12/2001 |
| WO | 0020221 | A1 | 4/2000 |
| WO | 03039881 | A1 | 5/2003 |

OTHER PUBLICATIONS

Nissan Chemical America Corporation, SNOWTEX, Mar. 1, 2005 (4 pages).*
HPDC, Notice of Opposition dated Sep. 24, 2009, EP App. No. 03024389.3.

* cited by examiner

*Primary Examiner* — Betelhem Shewareged

(57) ABSTRACT

An ink jet recording sheet is provided that delivers a photoparity image when printed with ink jet printer. The recording sheet comprises a two-layer coating. The bottom layer comprises amorphous silica and the top layer comprises spherical colloidal silica. Both silicas are rendered cationic. The recording sheet provides fast dry time, excellent image quality and superior water resistance and handle ability.

19 Claims, 1 Drawing Sheet

INK JET RECORDING SHEET WITH PHOTOPARITY

TECHNICAL FIELD

The present invention relates generally to ink jet printing, and, more particularly, to the print media employed in ink jet printing.

BACKGROUND ART

There are a variety of known methods for fabricating an ink jet recording sheet, or print media having a glossy surface for near-photographic prints. One example is directed to a single layer coated paper that uses alumina in the ink-receiving layer. The commercial paper coated with alumina on paper base can provide excellent gloss and absorbing capacity, but it has poor scratch resistance, poor air fading resistance and suffers cockle when the paper is wet.

A second example is directed to a coating with alumina base layer and a colloidal silica top layer. The design helped the scratch resistance but has lower lightfastness, poor air fading resistance, and bleed in humid conditions all associated with alumina pigments. Another important pigment is silica. Coatings based on silica pigment have better porosity, are less hygroscopic and have better air and light fading resistance.

A third example is directed to products with a single layer comprising porous (amorphous) silica pigments. However, the product has low gloss, typically below 20 gloss units at 20 degrees incident angle (as measured).

Finally, an ink jet-receiving sheet using anionic spherical silica coated on anionic amorphous porous silica has been developed. The design provides excellent image quality and gloss, but the water fastness and humid fastness performance are not as good as one might like, because the black pigment used has a negative charge, and therefore, has no mordant power to the dye molecules, which are usually anionic in the color inks.

Thus, while anionic $SiO_2$ is available, it does not provide both good gloss and porosity at the same time as a single layer. A two-layer combination (ink receiving layer) of anionic amorphous $SiO_2$ (bottom layer) and anionic spherical $SiO_2$ (top layer) provides good gloss; however, the waterfastness, the humid fastness, and the affinity of the receiving layer to dye (anionic) are not good. As mentioned above, a two-layer combination comprises $Al_2O_3$ (bottom layer) and $SiO_2$ (top layer), which also is deficient, as noted above.

A need remains for a print medium having a coating thereon that evidences acceptable gloss, but avoids all, or at least most, of the problems of the prior art.

DISCLOSURE OF INVENTION

In accordance with the embodiments disclosed herein, an ink jet recording sheet is provided that delivers a photoparity image when printed with ink jet printer. By "photoparity" is meant that the image is essentially equivalent to a conventional silver halide photograph. The recording sheet comprises a two-layer coating. The bottom, or first, layer comprises amorphous silica and the top, or second, layer comprises spherical silica. Both silica layers are processed either with aluminum chlorohydrate or with a cationic polymer and are rendered cationic. The recording sheet provides excellent gloss, fast dry time, excellent image quality, and superior water resistance and handle ability.

The method of preparing the ink jet recording sheet comprises:

(a) providing a substrate;

(b) forming the first layer on the substrate by (1) providing amorphous $SiO_2$, (2) adding the amorphous $SiO_2$ to a cationic-inducing compound to form a dispersion, (3) adjusting its pH to about 4, if necessary, (4) mixing the dispersion with a binder to form a mixture; and (5) coating the mixture on the substrate; and (c) forming the second layer on the first layer by (1) providing spherical silica, (2) mixing the spherical silica with either little or no binder, and (3) coating the spherical silica on the first layer.

The two layers may be formed on the substrate either in a single pass mode, such as using cascade coating or curtain coating, for example, or in two separate processes.

The ink jet receiving sheet disclosed herein provides image gloss, water fastness, and humid fastness, along with good ink receiving capacity at the same time. Further, the ink jet recording sheet provides improved scratching resistance and better ink receiving porosity than the single coated layer product, is different than the alumina/silica two layer product in that it uses an amorphous silica layer as the ink receiving layer, therefore providing better light and air fading resistance, and provides better gloss than the single layer amorphous silica product. Finally, the ink jet recording sheet is an improvement over the dual silica approach in providing better water fastness and humid fastness properties.

BRIEF DESCRIPTION OF THE DRAWINGS

The sole FIGURE depicts an embodiment of the ink jet recording sheet disclosed herein.

BEST MODES FOR CARRYING OUT THE INVENTION

Figure 1:
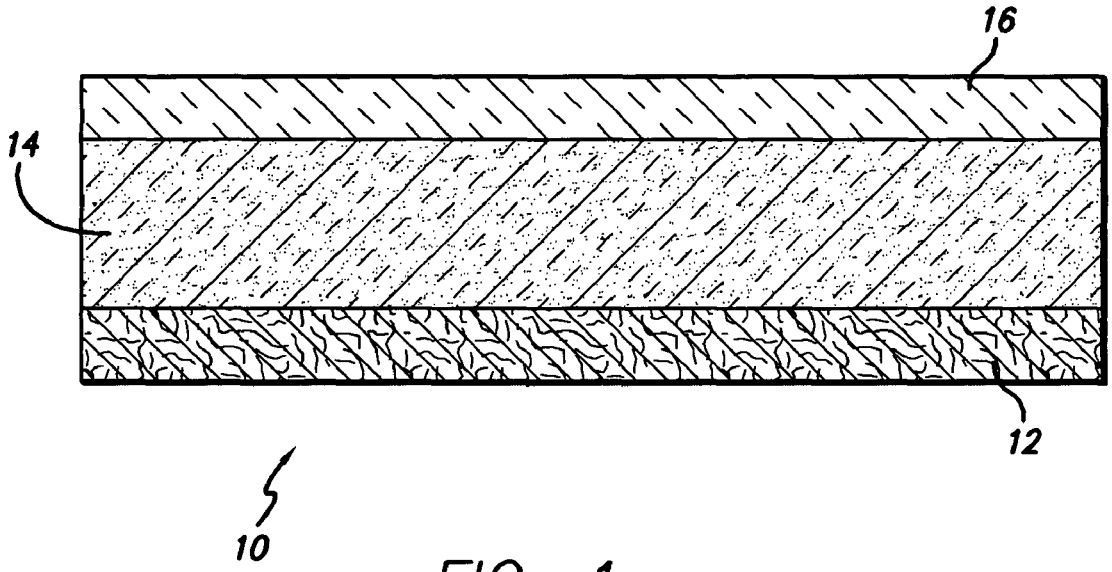

The ink jet receiving sheet 10 comprises a two-layer coating on a substrate 12.

The bottom, or first, layer 14 of the coating comprises an amorphous silica, preferably fumed silica or silica gel. The silica is treated with suitable agents to make the silica cationic. Cationic silica has good compatibility with cationic mordant to form a uniform smooth coating. The silica is in an aggregate form. The aggregate particle size is about 50 to 500 nm. The primary particle in the aggregate can range in size from 5 to 30 nm, with a surface area between 100 to 350 $m^2$/gram. With suitable amount binder, the bottom layer forms an ink receiving layer with a porosity of about 0.8 to 1.2 $cm^3$/g. The binder ratio is in the range of 15% to 30% of the total silica/binder composition. The thickness of the coating 14 may vary from 18 to 40 g/$m^2$, depending on the ink flux of the particular ink jet printer employed in printing.

The top, or second, layer 16 of the coating comprises a spherical colloidal silica. The silica has a particle size ranging from 30 to 150 nm. The binder ratio in the topcoat range from 0 to 15% of the total silica/binder composition, depending on the printing speed accommodated. The spherical silica in the topcoat 16 is also made cationic by suitable treatment. Again, the cationic treatment makes the pigment more compatible with the bottom layer and also with the dye mordant added in the top or bottom layer. The thickness of the top coat 16 is between 0.1 to 10 micrometers, or 0.1 to 12 g/$m^2$ coat weight.

The substrate 12 may comprise any of the materials commonly used to support receiving layers; examples include polyethylene-extruded photobase, film base, and highly sized paper base. Preferably, P-E photobase is employed as the substrate, due to its higher gloss, water resistance, and "feel" (like a photo).

The lower layer 14 (amorphous $SiO_2$) has a relatively high capacity for ink printed on the print media, where the ink load is on the order of 23 to 24 $cm^3/m^2$. The thickness of the lower layer is thick enough to accept that ink load, or, expressed alternatively, 1 g of amorphous $SiO_2$ can absorb about 0.9 to 1 g of ink. This provides a thickness of the lower layer 14 of about 25 to 30 $g/m^2$.

The amorphous $SiO_2$ used in the lower layer 14 comprises particles having a diameter within the range of 5 to 30 nm. These particles form secondary particulates, due to aggregation, which are stable against break down. Consequently, the secondary particulates form relatively large pore volumes. The pore size of the lower layer 14 is in the range of about 10 to 40 nm, preferably about 25 nm. If the pore size is too small, then the rate of ink absorbency is not high enough, while if the pore size is too large, then the gloss is unacceptably low.

The amorphous $SiO_2$ is derived from fumed silica and dispersed. That is, the amorphous fumed silica is available as an agglomerate. The agglomerate is dispersed to form the aggregate, such as by shearing. Alternatively, ground silica gel may be used to form the amorphous $SiO_2$ layer. Here, the amorphous silica gel is broken down to smaller particles, such as by physical grinding.

The upper layer 16 (spherical $SiO_2$) is not very porous, compared to the lower layer 14, and provides the desired glossiness to the product. The thickness of the upper layer 16 is about 0.1 to 10 $g/m^2$. The particle size is within the range of 25 to 100 nm, and preferably about 50 to 75 nm. If the particle size is too big, then the opacity is too high and will not generate a bright color, due to dye penetration, while if the particle size is too small, the pore is too small, and thus not a high enough absorbing rate of the ink. Also, if the particle size is too small, it will cause bronzing, in which the dye is left on top of the paper.

The process steps for forming the product are as follows:

(a) form the bottom layer 14 on the substrate 12 by (1) providing powdered fumed $SiO_2$, (2) adding the $SiO_2$ to a cationic-inducing compound, (3) adjusting the pH to about 4, if necessary, using an appropriate base to disperse the silica in the hydroxyl-containing polyvalent metal salt, (4) mixing the dispersion with a binder; and (5) coating the mixture on the substrate 12; and (b) form the top layer 16 by (1) providing cationic spherical silica, (2) mixing with either little or no binder, and (3) coating the spherical silica on the bottom layer 14.

The addition of the cationic-inducing compound to the fumed silica may already provide the silica with a pH of about 4. If not, then the pH is adjusted to the desired pH, using a suitable acid.

By "little binder" is meant about 5% binder or less.

The cationic-inducing compound is selected from the group consisting of hydroxyl-containing polyvalent metal salts and cationic resins.

An example of a hydroxyl-containing polyvalent metal salt is aluminum chlorohydrate (ACH), a cationic modifying agent. Such polyvalent metal salts have been described in U.S. Pat. No. 3,007,878, entitled "Aquasols of Positively-Charged Coated Silica Particles and Their Production", issued to G. B. Alexander et al on Nov. 7, 1961, the contents of which are incorporated herein by reference. These hydroxyl-containing polyvalent metal salts are members of a class consisting of metal oxides, metal hydroxides and hydrated metal oxides, the metal in each case having a valence of 3 to 4. Typical metal atoms are aluminum, titania, zirconia and thoria. The preferred ACH compound is $Al_x(OH)_yCl$, wherein x and y are selected such that the ratio of x:y is from between 1:2 and 1:2.8. A preferred example thereof is $Al_2(OH)_5Cl$.

Instead of the ACH addition (or hydroxyl-containing polyvalent metal salt), a cationic agent or polymer (resin) may be used in its place. Again, the pH is adjusted to 4 as needed. Examples of cationic agents and resins include, but are not limited to: polyalkylenepolyamines, for example, polyethylene polyamines and polypropylenepolyamines; and silica coupling agents with primary, secondary, or tertiary amino groups or quaternary ammonium groups, for example, amino-propyltriethoxy silane; N-(2-aminoethyl)-3-amino-propylmethyl dimethoxysilane; diethylenetriamine-propyl triethoxysilane, N-trimethoxysilylpro-pyl-N,N,N-trimethylammonium chloride, dimethoxysilylmethylpropyl modified polyethyleneimine, N-(3-triethoxylilylpropyl)-4,5-dihydroimidazole; and aminoalkylsilsesquioxane. The cationic resins suitably employed herein also include polycation cationic resins, for example, polyamidoamine-epichlorohydrin addition products.

As yet another embodiment, both the hydroxyl-containing polyvalent metal salt (e.g., ACH) and cationic polymer may be employed to render the anionic silica cationic.

During the dispersing process, the combination of ACH (or cationic polymer) and $SiO_2$ coact to transform the anionic silica surface to a cationic surface by dispersion of the ACH (or cationic polymer) on the surface of the silica particles, which makes the surface stable in water. As a result of this process, there is a positive zeta ($\zeta$) potential on the surface at the above-mentioned pH of 4.

An example of the binder employed in the practice of the embodiments disclosed herein is water-soluble and water-dispersible poly(vinyl alcohol). The water-soluble or water-dispersible poly(vinyl alcohol) may be broadly classified as one of the two types. The first type is fully hydrolyzed water-soluble or water-dispersible poly(vinyl alcohol) in which less than 1.5 mole percent acetate groups are left on the molecule. The second type is partially hydrolyzed water-soluble or water-dispersible poly(vinyl alcohol) in which from 1.5 to as much as 20 mole percent acetate groups are left on the molecule.

Another example of the binder employed in the practice of the embodiments is modified poly(vinyl alcohol). The basic poly(vinyl alcohol) is the same as those described above, with the modifying groups including, but not limited to, acetylacetal and acrylate. The degree of modification can range from 0 to 20 mole percent.

Additional examples of binders suitably employed in the practice of the present embodiments include, but are not limited to, water-soluble and water-dispersible poly(vinyl pyrrolidone)s, water-soluble and water-dispersible copolymers of vinyl acetate and vinyl pyrrolidone; water-soluble and water-dispersible acrylate polymers, water-soluble and water-dispersible poly(urethane)s, and water-soluble and water-dispersible polyethylene oxides.

The spherical silica naturally has an anionic charge. The spherical silica particles, being colloidal, naturally have a negative charge. The negative charge is converted to a cationic charge by treating with hydroxyl-containing polyvalent metal salt (e.g., ACH) or a cationic polymer, as described above. The polyvalent metal salt (or cationic polymer) used in treating the spherical silica may be the same as used in treating the amorphous silica, as described above, or different.

The coating of the two layers may be done in one pass, coating first the bottom layer 14 and then the top layer 16. One process that may be used includes utilizing a two-layer coating head. Cascade coating and curtain coating are two examples of such coating processes. Alternatively, the coating of the two layers may be done in two passes, in which the bottom layer 14 is coated on the substrate 12, then provided with a re-wet solution (not shown), and then the top layer 16 coated on the re-wet bottom layer. An example of the former (one-pass) process is disclosed in EP 1 162 076B1, entitled "Dye-Receiving Material for Ink-Jet Printing", issued Dec. 12, 2001, to Rolf Steiger et al and assigned to Ilford Imaging Switzerland GmbH (Example 23). An example of the latter (two-pass) process is the subject of U.S. Pat. No. 6,475,612, issued Nov. 5, 2002, and entitled "Process for Applying a Topcoat to a Porous Basecoat" by Douglas E. Knight et al and assigned to the same assignee as the present application. The entire contents of the foregoing references are incorporated herein by reference.

Without the top layer 16, the gloss of the ink jet receiving sheet 10 is low. Further, unless the bottom layer 14 is cationic, it is not possible to lay down the cationic top layer 16 over the bottom layer in a single pass.

The combination of a cationic bottom layer 14 and a cationic top layer 16 is advantageous, in that since the dyes in the ink jet inks being printed on the coated paper 10 are typically anionic, then improved water fastness and smear fastness is obtained, due to the interaction of the anionic dye on the cationic surface, leading to a strong affinity of the dye and the receiving layer.

EXAMPLES

Example 1

A. Treatment of Spherical Silica:

To 104.2 grams of water in a beaker was added 113.8 grams of 50% aluminum chlorohydrate obtained from Gulbrandsen. 382.0 grams of spherical silica (Nissan MP1040) was dispersed in this solution using an IKA dispersing tool. The particle size distribution of spherical silica in the dispersion was the same as the as-received spherical silica. The zeta potential of the treated spherical silica was +37.2 mv (cationic), while the untreated silica had a zeta potential of −27 mv.

B. Treatment of Fumed (Amorphous) Silica:

To 388.1 grams of water in the beaker was added 23.8 grams of 50% aluminum chlorohydrate. Under strong agitation, 88.1 grams of fumed silica (Cab-O-Sil M-5 from Cabot Corp.) was added. Agitation was continued for 1.5 hours. The agitation was stopped, and the fumed silica mixture was allowed to sit for 24 hours before use in the coating formulation. The solids content was 20%. The pH of the dispersion was 3.4 and the zeta potential was measured as +27.5 mv, indicating that the silica pigment was successfully transformed to a cationic form.

C. Formulation of Coating.

The following formulation was prepared as the base coat:

| Component | Parts by weight |
|---|---|
| Silica | 78 |
| Lactic acid | 2.2 |
| Airvol 165 | 17.2 |
| Boric acid | 2 |
| Glycerol | 0.6 |
| Total | 100.0 |

The foregoing base coat was formed by mixing 78 parts of amorphous silica treated in step 2 with 2.2 parts of lactic acid and 2 parts of boric acid. 17.2 parts of polyvinyl alcohol (Airvol 165 from Air Products) was mixed with 0.6 part of glycerol. Then, the amorphous silica and the polyvinyl alcohol were mixed together thoroughly. The mixture Was coated on photobase substrate with a wire bar to provide 25 g/m$^2$ dried coating.

The top coat was formed by first diluting the treated spherical silica to 10% solid and adding 1.5% surfactant (10G from Arch Chemicals, Inc.). 0.5 g/m$^2$ was coated on top of the base coat to obtain the two-layer coating, forming a glossy print media.

Example 2

To 388.1 grams of water in a beaker was added 10% NH4OH 6 ml and 23.8 grams of 50% aluminum chlorohydrate. Under strong agitation, 88.1 grams of fumed silica (Aerosil 200 from Degussa) was added. Agitation was continued for 1.5 hours. The agitation was stopped and the fumed silica was allowed to sit for 24 hours before use in the coating formulation. The solids content was 20%. The pH of the dispersion was 4.1 and the zeta potential was measured as +27.6 mv.

The following formulation was made by using the treated silica from step 1; the mix was used as the base coat:

| Component | Parts by weight |
|---|---|
| Aerosil 200 (step 1) | 73.84 |
| PVOH MO 26-88 | 18.46 |
| Plasticizer | 3.00 |
| Boric acid | 3.10 |
| Glycerol | 0.66 |
| Surfactant 10G | 0.91 |
| Total | 100.0 |

A cationic colloidal silica (Cartocoat 303 C from Clariant) was diluted to 0.3% solids, mixed with 0.2% glycerol and 0.2% Surfactant 10 G (Archie Chemicals). The formulation was used as the top coat.

A two-layer coating was laid down by using cascade coating at the same time in one pass. The coat weight of the bottom layer was about 28 to 30 g/m$^2$ and the top layer was 0.2 g/m$^2$. A glossy print media was obtained.

Example 3

Example 3 was the same as Example 1, except that the amorphous silica was treated with an aqueous solution of aminoalkylsilsesquioxane (WSA-9911 from Gelest, Inc.), rather than treated with aluminum chlorohydrate, and the top coat silica was Cartacoat C203 instead of MP 1040 from Nissan Chemical. The treating agent was first neutralized to pH=4 and 4% of WSA-9911 was used in the treatment. A glossy print media was obtained.

Comparative Example 1

Comparative Example 1 was the same as Example 2, except that the base coat was switched to an alumina-based coating. The base coat formulation was as follows:

| Component | Parts by weight |
|---|---|
| Disperal 14/4 | 86.2 |
| PVOH MO 26-88 | 9.1 |
| Lactic acid | 1.4 |
| Lactic nitrate | 0.3 |
| Trimethylolpropane | 0.8 |
| Glycerin | 0.8 |
| Boric acid | 1.0 |
| Triton X-100 | 0.4 |
| Total | 100.0 |

Comparative Example 2

Comparative Example 2 was the same as Example 2, but without the Cartacoat C303 top coat on the bottom coat.

Comparative Example 3

Comparative Example 3 was the same as Comparative Example 1 but without Cartacoat as the top coat.

Comparative Example 4

Comparative Example 4 was the same as Example 2, except that anionic Snowtex MP1040 (Nissan Chemical) was directly used as the top coat and the top coat was applied as a second pass rather than using cascade coating (which formed the two layers in a single pass).

Results.

The samples were printed on a HP DeskJet 970 printer with an experimental ink set. The samples were evaluated fully by methods commonly used in the this field.

Gloss was measured with BKY Gardner micro-TRI-gloss meter at 20 degree incident angle.

Cracks were examined under a Beta color proofing viewer with 25×amplification.

Porosity was measured by using a gravimetrical method. A sample of coated paper with known size was weighed, water was sprayed on the paper to fill the pores in the coating layer, the surface water was removed with a paper towel, and the weight of the sample was re-measured. The weight difference was used to characterize the absorbing capacity and was further used to calculate the coating porosity based on the coated weight of the sample.

Scratch resistance was evaluated qualitatively using an abrasion apparatus that simulated finger nail resistance. If a mark was visible, then the sample was rated as poor. In contrast, if the scratching mark was not visible, then the sample was rated as good.

Water and Humid Fastness were Measured as Follows:

Water fastness was tested by dropping 25 micro liter of water on a printed sample that was placed on a 45 degree slanted surface. If the waterfastness of the image was poor, then the water carried the color or even the coating away from the printed surface to the adjacent unprinted area. The optical density increase was used as a quantitative measure of water-fastness.

Humidfastness was measured by subjecting the printed samples to four days at high humidity (80%) and elevated temperature (usually 30 degree C.). The difference between the line widening and hue shift was used as a measure of humid fastness. A line widening of less than 10 microns and a hue shift of less than 10 delta E units was rated as good.

Air fading resistance was evaluated by using an air fading box. Printed image samples were placed on the shelves in the fading box. Natural air containing air pollutant was blown on top of the samples in a speed of 500 feet/minute. The percent optical density loss of the image samples, after they were subjected to fading for two weeks, was used to characterize the air fade stability of the imaging system.

The following results were obtained:

| Media | Sample 1 | Sample 2 | Sample 3 | Comp. 1 | Comp. 2 | Comp. 3 | Comp. 4 |
|---|---|---|---|---|---|---|---|
| Gloss | 41.5 | 42.3 | 38.6 | 32.6 | 14.4 | ~28 | 42 |
| Cracking | none | none | none | none | none | none | none |
| Porosity ($cm^3/g$) | 0.93 | 0.92 | 0.87 | 0.46 | 0.92 | 0.46 | 0.91 |
| Scratch | good | good | good | good | good | poor | good |
| Water and humid fastness | good | good | good | good | good | good | poor |
| Air fade - cyan (1) | 4.2 | 4.7 | 8.7 | 10.4 | 4.9 | 10.4 | 4.9 |
| Air fade - magenta (1) | 12.2 | 11.5 | 14.0 | 26.6 | 12.1 | 26.6 | 12.1 |
| Air fade - yellow (1) | 0.5 | 0.6 | 0.6 | 0.4 | 0.9 | 0.4 | 0.9 |
| Air fade - cyan (2) | 15.0 | 15.9 | 9.4 | 17.1 | 15.2 | 17.1 | 15.2 |
| Air fade - magenta (2) | 13.8 | 14.3 | 18.6 | 29.8 | 16.8 | 29.8 | 16.8 |
| Air fade - yellow (2) | 3.8 | 4.2 | 7.9 | 7.9 | 3.4 | 7.9 | 3.4 |

Notes:

(1) Air fade data from samples printed with the default ink used in the DeskJet 970 printer.

(2) Air fade data from samples printed with an experimental ink.

As can be seen, Comparative Example 1 and Comparative Example 3, both of which have an alumina-based coating, have poor air fading resistance, while other examples, coated with silica-based formulation, have much improved air fading resistance. The life-time of the images based on the silica pigment-based coating is determined to be twice as long as the alumina pigment-based coating. The reason for this superior air fading resistance for silica-based coatings is not known. However, without subscribing to any particular theory, it is believed to be associated with the pore size and different water affinity of two pigments.

The air fade data show that the effect of the print media is the same for both sets of inks.

Based on the results, it is clear that media coated with colloidal spherical silica has a much better gloss than the version without the topcoat. For silica-based coatings, the gloss can be easily increased from 15 units to 40 units.

Further based on the results, it can be seen that anionic colloidal silica alone, although it can dramatically improve the gloss, has poor water fastness and humid fastness. The dyes in the inks are penetrating to the bottom layer in humid condition, thereby generating an image with washed-out color.

The best media, which provide both image quality and durability, were those coated with two layers, comprising the cationic amorphous silica on the bottom layer and the cationic spherical colloidal silica on the top layer.

INDUSTRIAL APPLICABILITY

The cationic coated substrates are expected to find use in photographic-like printing of ink jet inks.

What is claimed is:

1. A coated paper, suitable for printing ink jet inks thereon and providing a photographic-like print, comprising:

(a) a substrate comprising a polyethylene-extruded photobase;

(b) a first ink-receiving layer disposed on said substrate and comprising a first cationic silica consisting of amorphous silica, mixed with a first cationic-inducing compound and a binder, wherein said amorphous silica has a primary particle size of about 5 to 30 nm and an aggregated particle size between about 50 and 500 nm; and (c) a second gloss-enhancing layer disposed on said first ink-receiving layer and comprising a second cationic silica consisting of spherical silica having a particle size of about 25 to 100 nm, mixed with a second cationic-inducing compound, said first cationic-inducing compound being the same or different than said second cationic-inducing compound;

wherein said first and second layers are formed by a process comprising:

mixing said amorphous silica with said first cationic-inducing compound and said binder to form a first coating mixture wherein said amorphous silica has a positive surface zeta potential;

mixing said spherical silica with said second cationic-inducing compound and 0-5% binder (by weight of said spherical silica and binder) to form a second coating mixture wherein said spherical silica has a positive surface zeta potential; and applying said first and second coating mixtures to said substrate simultaneously using one pass application with a two-layer coating head, wherein said coated paper has enhanced gloss and waterfastness.

2. The coated paper of claim 1 wherein said first and second cationic-inducing compounds are independently selected from the group consisting of hydroxyl-containing polyvalent metal salts containing a metal having a valence of 3 to 4 and cationic resins.

3. The coated paper of claim 2 wherein said metal is selected from the group consisting of aluminum, titania, zirconia and thoria.

4. The coated paper of claim 2 wherein said polyvalent metal salt comprises $Al_x(OH)_yCl$, wherein x and y are selected such that the ratio of x:y is within a range of 1:2 to 1:2.8.

5. The coated paper of claim 2 wherein said polyvalent metal salt is $Al_2(OH)_5Cl$.

6. The coated paper of claim 2 wherein said cationic resins are selected from the group consisting of polyalkylenepolyamines, silica coupling agents with primary, secondary, or tertiary amino groups or quaternary ammonium groups, and polycation cationic resins.

7. The coated paper of claim 6 wherein said polyalkylenepolyamines are selected from the group consisting of polyethylene polyamines and polypropylenepolyamines, wherein said silica coupling agents are selected from the group consisting of amino-propyltriethoxy silane, N-(2-aminoethyl)-3-aminopropylmethyl dimethoxysilane, diethylenetriamenepropyl triethoxysilane, N-trimethoxysilylpropyl-N,N,N-trimethylammonium chloride, dimethoxysilylmethylpropyl modified polyethyleneimine, N-(3-triethoxylilylpropyl)-4,5-dihydroimidazone; and aminoalkylsilsesquioxane, and wherein said polycation cationic resins are polyamidoamine-epichlorohydrin addition products.

8. The coated paper of claim 1 wherein said first ink receiving layer has a pore size within a range of about 10 to 40 nm.

9. The coated paper of claim 8 wherein said pore size is about 25 nm.

10. The coated paper of claim 1 wherein said first ink receiving layer has a thickness of about 18 to 40 $g/m^2$.

11. The coated paper of claim 1 wherein said second gloss enhancing layer has a thickness of about 0.1 to 10 $g/m^2$.

12. The coated paper of claim 1 wherein said first cationic inducing compound comprises a hydroxyl-containing polyvalent metal salt containing a metal having a valence of 3 to 4.

13. The coated paper of claim 12 wherein said metal is selected from the group consisting of aluminum, titania, zirconia and thoria.

14. The coated paper of claim 12 wherein said hydroxyl-containing polyvalent metal salt is $Al_x(OH)_yCl$, wherein x and y are selected such that the ratio of x:y is within a range of 1:2 to 1:2.8.

15. The coated paper of claim 12 wherein said polyvalent metal salt is $Al_2(OH)_5Cl$.

16. The coated paper of claim 12 wherein applying the first ink receiving layer comprises applying to said substrate a dispersion of said first cationic silica having a pH of 3.4-4.1.

17. The coated paper of claim 1 wherein applying the first ink-receiving layer comprises applying to said substrate a dispersion of said first cationic silica having a pH of 3.4-4.1.

18. The coated paper of claim 1 wherein said binder is selected from the group consisting of water-soluble or water-dispersible poly(vinyl alcohol)s, modified poly(vinyl alcohol)s, water-soluble or water-dispersible poly(vinyl pyrrolidone)s, water-soluble or water-dispersible acrylate polymers, water-soluble or water-dispersible copolymers of vinyl acetate and vinyl pyrrolidone, water-soluble or water-dispersible poly(urethane)s, and water-soluble or water-dispersible polyethylene oxides.

19. The coated paper of claim 1, wherein said second gloss-enhancing layer has a gloss value of 38.6-42.3 measured at a 20° viewing angle.

* * * * *

UNITED STATES PATENT AND TRADEMARK OFFICE

CERTIFICATE OF CORRECTION

PATENT NO. : 7,906,187 B2
APPLICATION NO. : 10/406967
DATED : March 15, 2011
INVENTOR(S) : Yubai Bi et al.

It is certified that error appears in the above-identified patent and that said Letters Patent is hereby corrected as shown below:

In column 10 line 16, in Claim 7, delete "triethoxylilylpropyl)" and insert -- triethoxysilylpropyl) --, therefor.

Signed and Sealed this
Thirty-first Day of May, 2011

David J. Kappos

David J. Kappos
*Director of the United States Patent and Trademark Office*